US006062672A

United States Patent [19]

Ishize et al.

[11] Patent Number: 6,062,672

[45] Date of Patent: May 16, 2000

[54] INK-JET TYPE IMAGE FORMING APPARATUS

[75] Inventors: Tatsuhiro Ishize; Takashi Suzuki; Takaaki Sekiyama, all of Ebina, Japan

[73] Assignee: Fuji Xerox Co., Ltd., Tokyo, Japan

[21] Appl. No.: 08/907,639

[22] Filed: Aug. 8, 1997

[30] Foreign Application Priority Data

Aug. 20, 1996 [JP] Japan ..... 8-218872

[51] Int. Cl.[7] ..... B41J 2/165

[52] U.S. Cl. ..... 347/30; 347/31; 347/36

[58] Field of Search ..... 347/30, 29, 31, 347/36

[56] References Cited

U.S. PATENT DOCUMENTS 5,311,214 5/1994 Hirasawa et al. ..... 347/6
5,717,444 2/1998 Sugimoto et al. ..... 347/29

FOREIGN PATENT DOCUMENTS

A-4-45953 2/1992 Japan .
A-6-226995 8/1994 Japan .
7-57547-B2 6/1995 Japan .

*Primary Examiner*—N. Le
*Assistant Examiner*—Shih-Wen Hsieh
*Attorney, Agent, or Firm*—Oliff & Berridge, PLC

[57] ABSTRACT

An ink-jet type image forming apparatus expells ink smoothly from a cap member to an expelled ink tank when the ink expulsion flowpath is in a horizontal direction. In the apparatus, a nozzle ejects ink according to the prescribed image information. A cap is located opposite to the nozzle while an expelled ink storage member stores the ink held in the cap member. An ink expulsion path forming member forms an expulsion path of ink from the cap member to the expelled ink storing member. This is accomplished through an ink transfer suction device arranged in an ink guide tubular member that causes ink to flow to the interior of the ink expulsion path forming member via an ink flowpath in the tubular member.

14 Claims, 21 Drawing Sheets

INK-JET TYPE IMAGE FORMING APPARATUS

BACKGROUND OF THE INVENTION

1. Field of the Invention

This invention relates to an image forming apparatus. More particularly, this invention relates to an ink-jet type image forming apparatus in which an image is formed by ejecting ink onto a recording medium such as paper.

2. Description of Related Art

Conventionally, an ink-jet type image forming apparatus includes, for example, a recording medium transfer member that transfers paper and the like in a specified transfer direction and a recording head carriage arranged opposite a transfer path of the recording medium. The carriage is movable in a direction perpendicular to the transfer direction of the recording medium and ejects ink from nozzles toward the transfer path of the recording medium.

Moreover, a full color ink-jet type image forming apparatus uses a recording head carriage capable of ejecting yellow, magenta, cyan and black inks. Further, the full color ink-jet type image forming apparatus generally comprises a plurality of nozzle components for each respective color, and a plurality of ink tanks that supply ink to the nozzle components. Moreover, each of the nozzle components has a plurality of nozzles formed therein and each of the ink tanks is designed to be attachable to and detachable from the recording head carriage.

The ink-jet type image forming apparatus carries the recording medium by the recording medium transfer member. An image is formed on the recording medium by ejecting ink onto the recording medium in accordance with the prescribed image information while the recording medium is being transferred and the recording head carriage is being moved back-and-forth across the transfer path.

However, this type of ink-jet type image forming apparatus has various problems in maintaining image quality. Poor image quality is associated with the ink itself, as well as the ink being ejected from the nozzles to form an image.

Specifically, in the aforementioned ink-jet type image forming apparatus, first, the ink in the nozzle is known to quickly dry out when images are not being formed. When this condition occurs, the viscosity of the ink increases, thereby changing the way the ink ejects from the nozzle components, such that the desired image is not properly formed.

Second, when foreign material or air enters the nozzles, or when the drying of the ink has progressed, the ink does not properly eject.

Third, it is known that the ejection of the ink occasionally is not stable and the image cannot properly be formed because the surface of the ink dries immediately after image forming begins.

Therefore, the established practice to overcome the above-mentioned problems in a conventional ink-jet type image forming apparatus is to provide a plurality of cap members to prevent the ink from drying by covering the nozzles when images are not being formed. Also, a pump member is added for suctioning ink from the cap members while an expelled ink tank stores the expelled ink held by the cap members. The aforementioned solutions are disclosed in Japanese Laid-Open Patent Publications 6-226995, 4-45953 and 60-145854.

Also, during a capping stage, the drying of ink in the ink-jet type image forming apparatus is prevented by covering each nozzle with a respective cap member. Sticky ink can also be removed from each nozzle by suctioning the ink when the nozzles are covered by their respective cap members. Further, during a dummy jet stage, the ejection blurring of ink that occurs during the beginning of image formation can be prevented in advance by ejecting the ink from each nozzle prior to initiating image formation. Moreover, during a recovery stage the ink-jet type image forming apparatus suctions the expelled ink held by each cap member during each of these operations and stores the expelled ink in an expelled ink tank.

However, in order for the expelled ink to properly flow from the cap member to the expelled ink tank in these ink-jet type image forming apparatus, it became necessary to form the expelled ink flow entry port on top of the expelled ink tank, and to set the direction of the ink expulsion flowpath in a vertical or inclined direction.

Consequently, because it was necessary to preserve the height from the top end of the recording head to the bottom end of the expelled ink tank, it was not possible to miniaturize the apparatus by making it thinner. This was due to the fact that the height in the ink-jet type image forming apparatus, measured from the top end of the cap member to the bottom end of the expelled ink tank, was typically designed so that the cap member was arranged opposite to the recording head.

SUMMARY OF THE INVENTION

Therefore, an object of this invention is to provide an ink-jet type image forming apparatus in which the expelled ink flows smoothly from the cap member to the expelled ink tank, even when the ink expulsion flowpath is set in a roughly horizontal direction.

It is another object of this invention to miniaturize the ink-jet type image forming apparatus by making it thinner.

The present invention provides an ink-jet type image forming apparatus having a nozzle part for ejecting ink corresponding to prescribed image information, a cap member arranged opposite to the nozzle part, an expelled ink storing member for storing ink supplied to the cap member from the nozzle part, and an ink expulsion path forming member for forming an expulsion path for ink from the cap member to the expelled ink storing member. The ink expulsion path forming member further comprises an ink guide tubular member that causes ink to flow to the interior of the ink expulsion path forming member and an ink transfer suction member arranged in the ink flowpath capable of suctioning ink.

The cap member is arranged opposite the nozzle part and covers the nozzle part when an image is not being formed. This is accomplished by arranging the cap member so that it is extendible to and retractable from the nozzle part.

The expelled ink storing member stores ink provided to the cap member by using an expelled ink suction member. The expelled ink suction member comprises an expelled ink tank having a space formed in its interior, such as a porous member, for example a sponge, in which ink is absorbed and maintained.

The ink expulsion path forming member has an ink guide tubular member that directs the ink to flow to the interior of the ink expulsion path forming member and an ink transfer suction member arranged in the ink guide tubular member that holds (e.g., absorbs) the ink. The ink expulsion path forming member forms the expulsion path of the ink from the cap member to the expelled ink storing member.

The ink guide tubular member allows the ink to flow through its interior and can be designed like a tube having a circular shape.

The ink transfer suction member is arranged in the ink guide tubular member to hold the ink and can be a felt or perforated material.

The expelled ink flows smoothly to the expelled ink storing member by suctioning and diffusion of the ink through the ink transfer suction member. This is accomplished because the ink-jet type image forming apparatus of the present invention comprises an ink guide tubular member that causes ink to flow to the interior of the ink expulsion path forming member and an ink transfer suction member arranged in the ink guide tubular member that is capable of holding the ink.

When the expelled ink storing member is contacting the ink transfer suction member and uses the expelled ink suction member for holding the ink, the ink holding power of the expelled ink suction member may be such that it is larger than that of the ink transfer suction member. This makes it possible to easily and reliably execute the operation in which the ink held in the ink transfer suction member is channeled to the expelled ink suction member such that the ink is directly and smoothly transferred to the expelled ink suction member. It should be noted that the phrase "ink holding power" describes the potential to absorb and hold the ink. For example, it is acceptable to have the density be high and the leakage low. Felt material or perforated material can be used as the material for suctioning the ink.

In an alternative embodiment, the expelled ink storing member may be separated from and interchangeable with the ink transfer suction member when the expelled ink storing member is designed to be interchangeable. Therefore, no ink would be remaining in the ink expulsion path forming member when the expelled ink storing member is switched.

In the alternative embodiment, when a pump is used to move the expelled ink from the cap member to the expelled ink storing member, the size of the ink flowpath in the ink guide tubular member may be broadened midway. Also, the ink transfer suction member may be positioned in the broadened region of the ink flowpath. By doing this, the area surrounding the apparatus does not become stained from scattered ink caused by an ink bubble bursting in the broadened region.

Furthermore, when the size of the ink flowpath of the ink guide tubular member is broadened midway, and the ink transfer suction member is arranged in this broadened portion, the ink transfer suction member may be separated from the border part of the flowpath where the size of the flowpath of the ink guide tubular member changes (i.e., increases). By doing this, it is possible to prevent the clogging up of the ink that occurs when the ink becomes sticky because the ink remains on the upstream side of the border part.

Further, in the case in which the size of the ink flowpath of the ink guide tubular member has been broadened midway and the ink transfer suction member is arranged in this broadened portion, the ink transfer suction member may be arranged so that the ink flowpath is not blocked. By doing this, it is possible for the ink to flow through the remaining part of the ink transfer path (i.e., around the ink transfer suction member) to the expelled ink suction member, making it possible to prevent the ink from clogging, even when the ink transfer suction member appears to be clogged.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

Hereafter, a detailed description of embodiments of the image forming apparatus of this invention is provided, based on the attached drawings.

Figure 1:
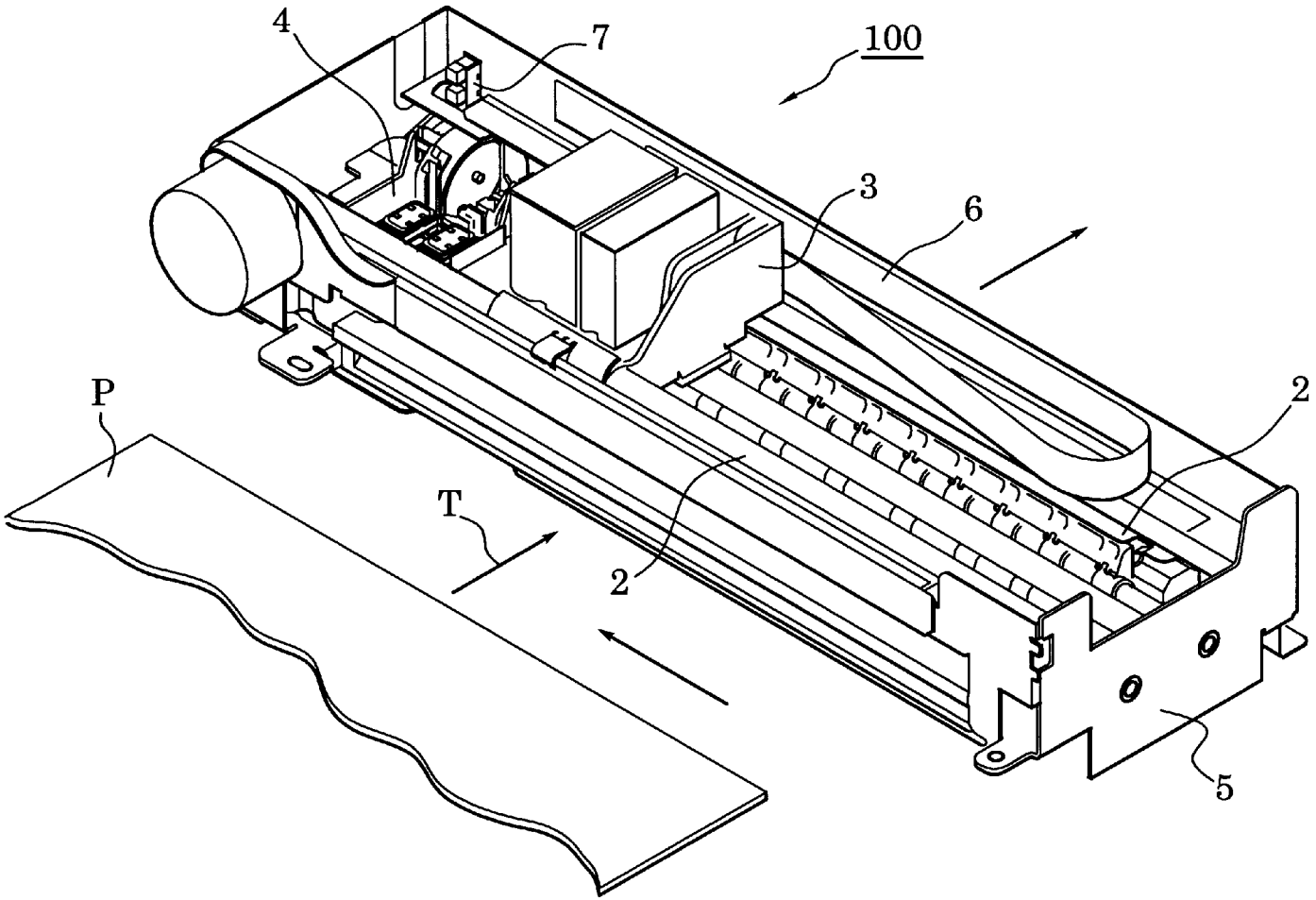
FIG. 1 is a perspective view of the ink-jet type image forming apparatus of a first embodiment of the invention.

An ink-jet type image forming apparatus 100 relating to a preferred embodiment is shown in FIG. 1.

Figure 3:
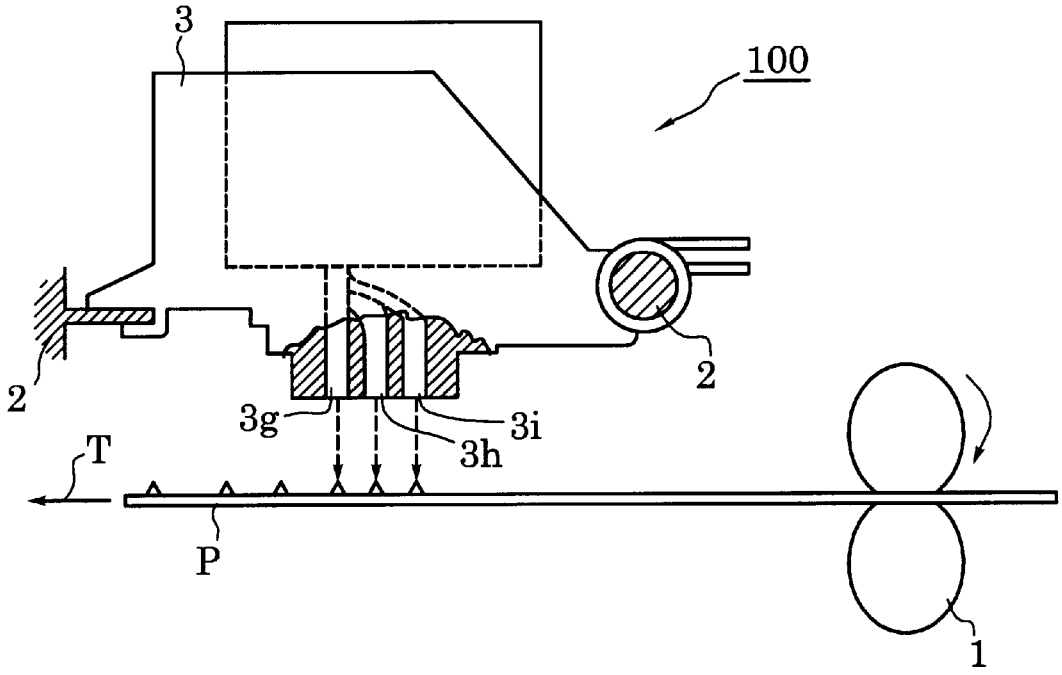
FIG. 3 is a side view of the image forming apparatus of FIG. 1 illustrating movement of a recording medium.

The image forming apparatus 100 has a recording medium transfer member 1, as depicted in FIG. 3, that transfers a recording medium P in a specified direction. Turning back to FIG. 1, a pair of a guide members 2 are positioned opposite the transfer path of the recording medium P and extend in a direction perpendicular to the transfer direction of the recording medium P. The recording head carriage 3 is supported by the guide members 2. Maintenance station 4 is arranged under guide members 2 and close to the transfer path of the recording medium P, while housing 5 houses all of the aforementioned elements. Prescribed image information is sent to the recording head carriage 3 through a signal line 6 which is formed in a flexible base. The home position of the recording head carriage 3 is detected by a home position sensor 7 that is arranged at a position opposite the maintenance station 4.

Figure 2:
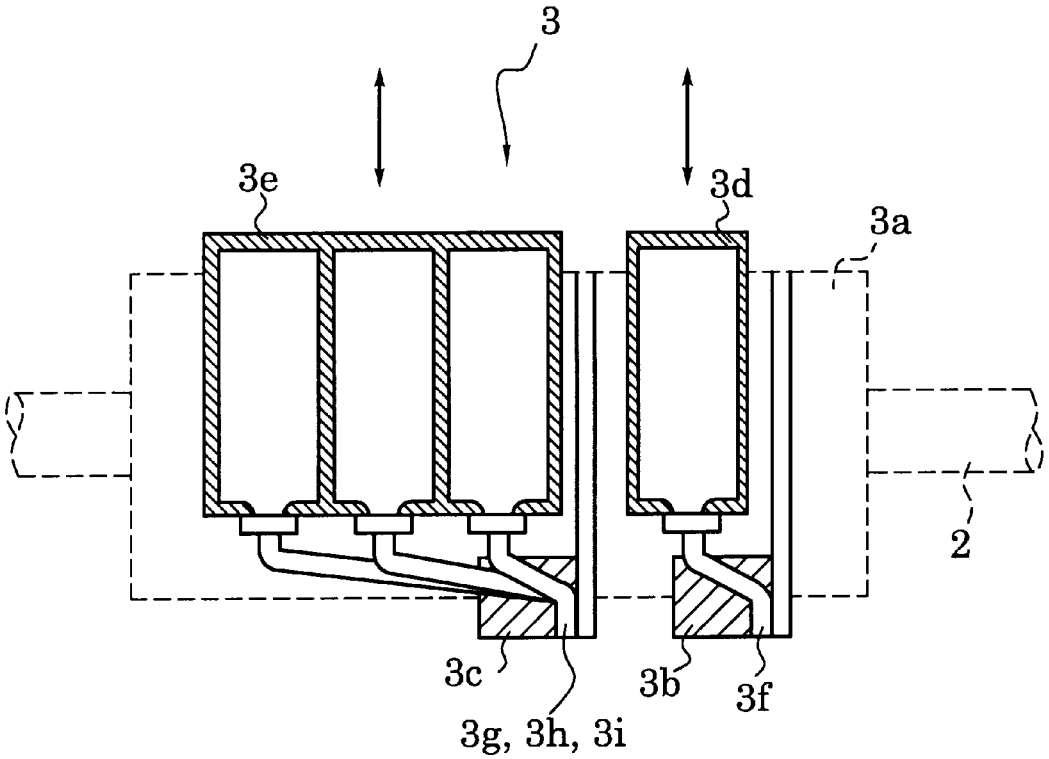
FIG. 2 is a sectional view of a recording head carriage shown in FIG. 1.

As shown in FIG. 2, the recording head carriage 3 comprises a head carriage frame 3*a* arranged so as to be movable on the guide members 2. Nozzle members 3*b* and 3*c* are arranged so as to project lower than the bottom surface, which is the surface that faces the recording medium transferring path, of the head carriage frame 3*a*. Ink tanks 3*d* and 3*e* supply ink to nozzle members 3*b* and 3*c*, which are attachable to and detachable from the frame 3*a*.

As illustrated in FIG. 2, multiple nozzles 3*f*, 3*g*, 3*h* and 3*i* may be arranged in nozzle members 3*b* and 3*c*. In nozzle member 3*b*, a single color of ink is ejected in response to the prescribed image information since the ink tank 3*d*, which is connected to the nozzle 3*b*, supplies black ink only. Additionally, in nozzle member 3*c*, three colors of ink are capable of being ejected in response to the prescribed image information since the ink tank 3*e*, which is connected to the nozzle member 3*c*, supplies yellow ink, magenta ink and cyan ink. In FIG. 2 of this embodiment, the nozzles for each color described above have been shown as one nozzle for convenience. For example, nozzle 3*f* represents the nozzle group for black ink, nozzle 3*g* represents the nozzle group for yellow ink, nozzle 3*h* represents the nozzle group for magenta ink and nozzle 3*i* represents the nozzle group for cyan ink.

As indicated in FIG. 3, image formation apparatus 100 forms a specified image on recording medium P when recording medium transfer member 1 transfers recording medium P through the apparatus 100 and recording head carriage 3 ejects ink onto the recording medium P in accordance with the prescribed image information. This causes the recording head carriage 3 to move in a back-and-forth motion.

Figure 4:
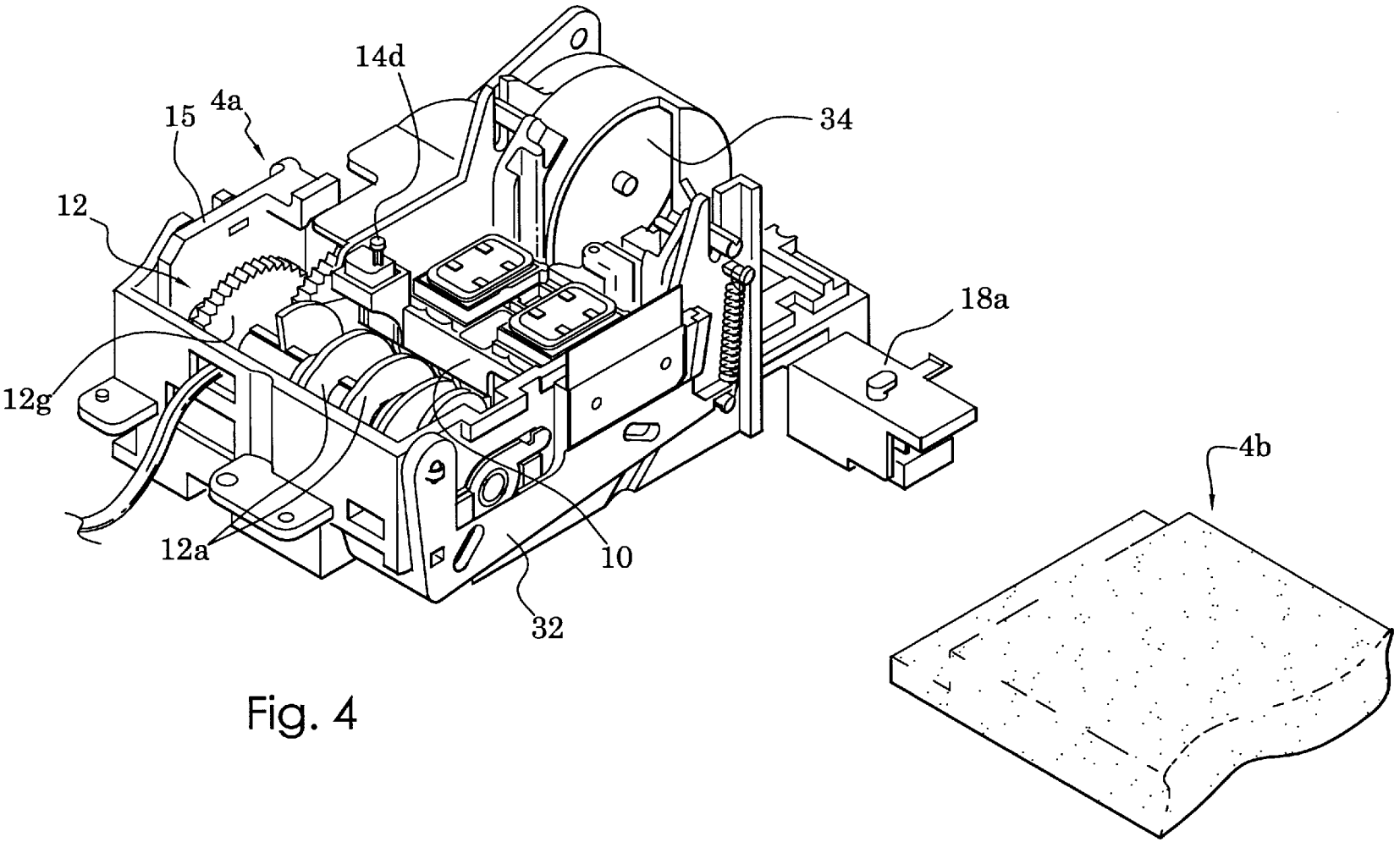
FIG. 4 is a perspective view of a maintenance station.

The maintenance station 4, as indicated in FIG. 4, comprises a station main body 4*a* and an expelled ink storing member 4*b* which absorbs and holds the ink expelled from the station main body 4*a*.

Figure 5:
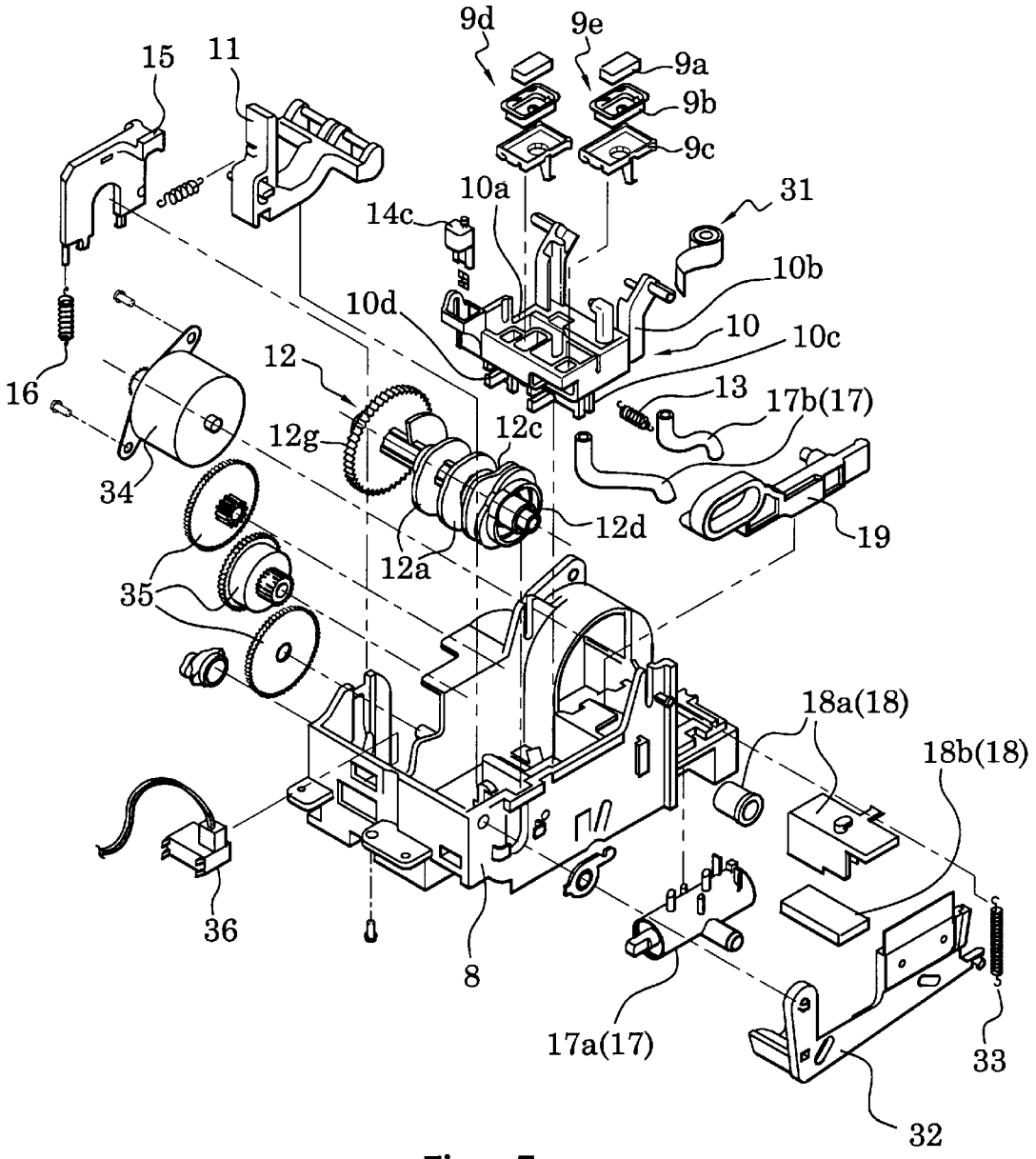
FIG. 5 is an exploded perspective view of the maintenance station of FIG. 4.

The station main body 4*a* comprises a unit housing 8 as indicated in FIG. 5 and various members attached thereto.

Figure 16A:
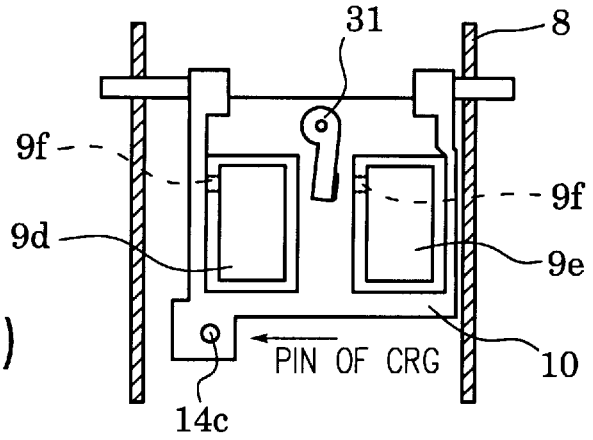
FIGS. 16A–16C are side views of a cap member having a through-hole and disposed in a sequence of positions.

In FIG. 5, ink holder, or ink carrier, 9*a* is formed by a sponge. Rubber cap 9*b* has a concave part formed therein that holds the ink carrier 9*a*. Cap 9*b* also has a through-hole 9*f* (FIGS. 16A and 16C) formed therein that goes through the concave part to the side surface. Cap case 9*c* holds the rubber cap 9*b*. Moreover, the station main body 4*a* has two cap members 9*e* and 9*d*, which are held on the cap carriage 10. Each cap member assembly includes one ink carrier 9*a*, one cap member 9*b* and one cap case 9*c*.

Figure 6:
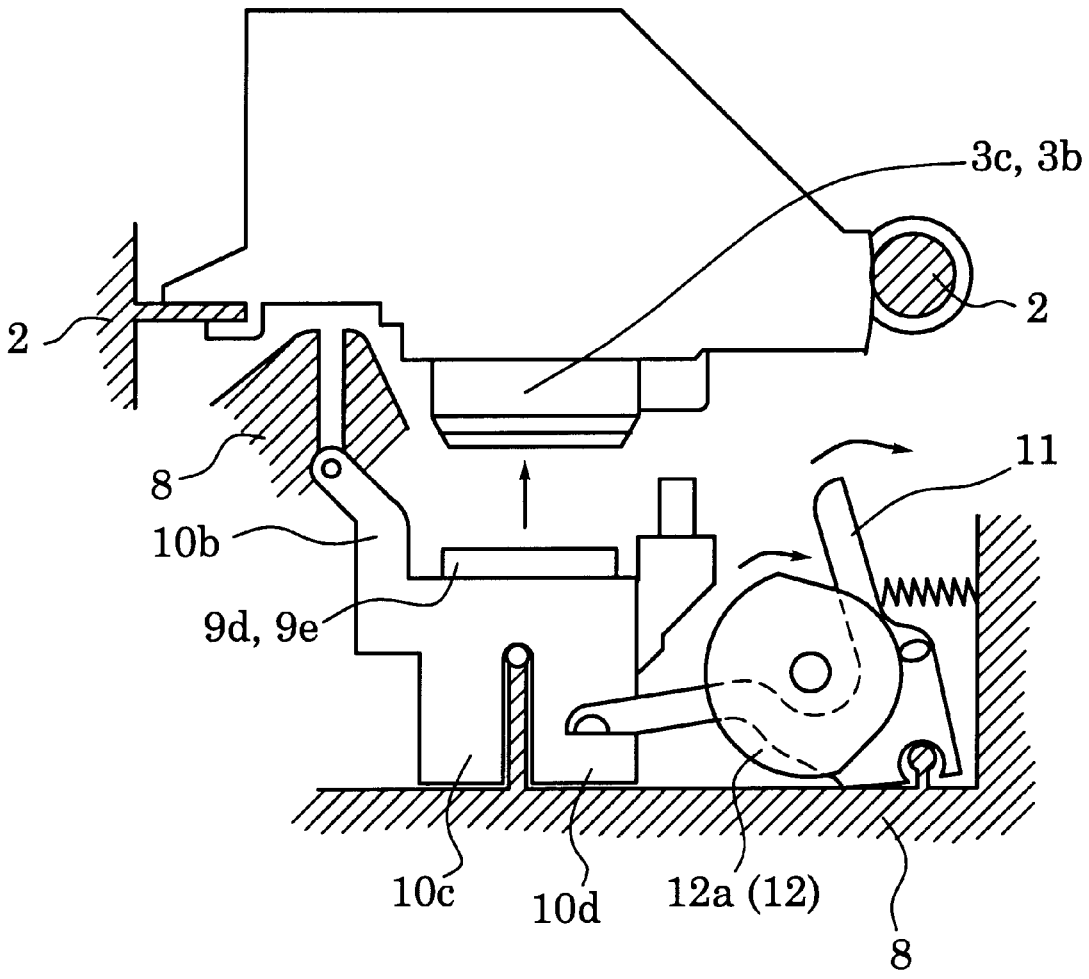
FIG. 6 is a side view of a cap member and a cam drive transfer member.

The cap carriage 10 has a supporting bottom plate 10*a* that supports the two cap members 9*e* and 9*d*. A pair of arm parts 10*b* are arranged on both ends of one side of cap carriage 10. Guide part 10*c* is arranged under the supporting bottom plate 10*a* while supporting point part 10*d* is arranged under the supporting bottom plate 10*a* and adjacent the guide part 10*c*. Functionally, as shown in FIG. 6, when the arm part 10*b* and guide part 10*c* are joined to the unit housing 8, the supporting part 10*d* is connected to an L-shaped arm 11 and the L-shaped arm 11 is able to move up and down while maintaining its form position by being shaken by a cam 12*a*. Hereafter and for convenience, the member forming the cam 12*a* will be referred to as the cam drive transfer member 12.

Moreover, the cap carriage 10, as indicated in FIG. 7, is arranged so as to be movable in the same direction as the direction of movement of the recording head carriage 3, which will hereafter be called the left or right direction. A spring 13 applies a force to the right side of the cap carriage 10.

Figure 8:
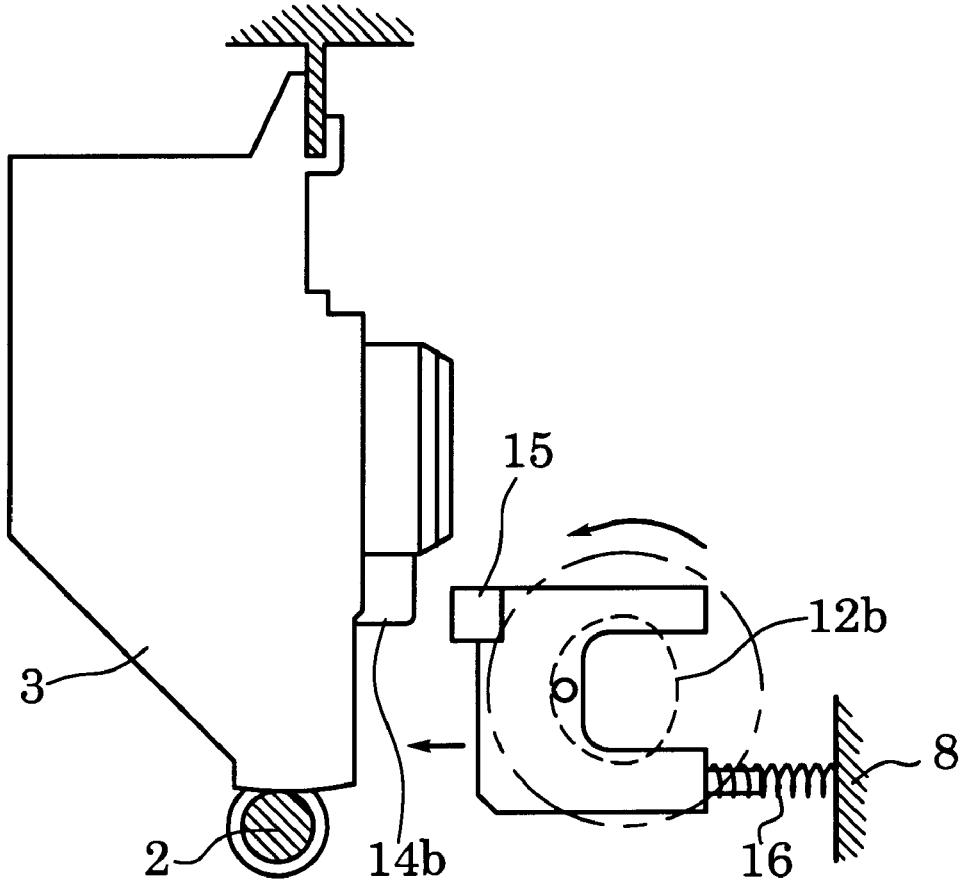
FIG. 8 is a side view of the cap carriage engaging member and the carriage position fixing member of FIGS. 7A–7D illustrating a locking operation.

On the recording head carriage 3 two projections 14*a* and 14*b* are formed that are right next to the two nozzle sections 3*b* and 3*c*. An engagement pin 14*c* is arranged on the cap carriage 10 in a position that corresponds to the path of motion of the two projections 14*a* and 14*b*. A fixing pin 15 is arranged proximate the engagement pin 14*c* so that it is movable in the up-and-down direction in the station main body 8. The fixing pin 15, as indicated in FIG. 8, is biased upwards by a spring 16 that is inserted between a unit housing 8 and the fixing pin 15. The fixing pin 15 also engages the ditch part of the gear of the cam drive transferring member 12, thereby setting the height of the fixing pin 15.

Figure 7A:
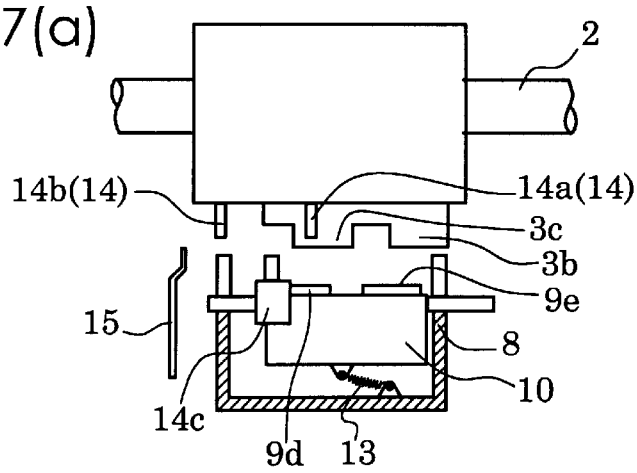
FIGS. 7A–D are side views of a cap carriage engaging member and a carriage position fixing member illustrating a capping operation.
Figure 7B:
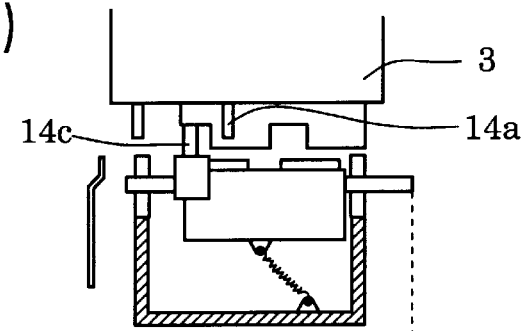
Figure 7C:
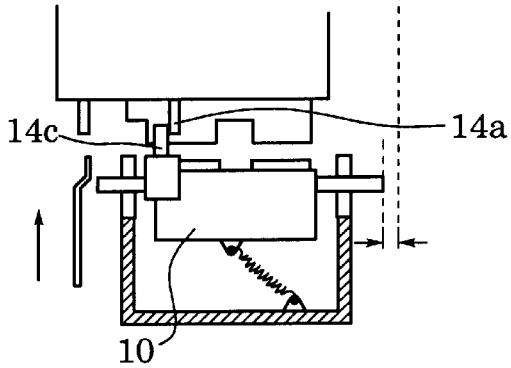
Figure 7D:
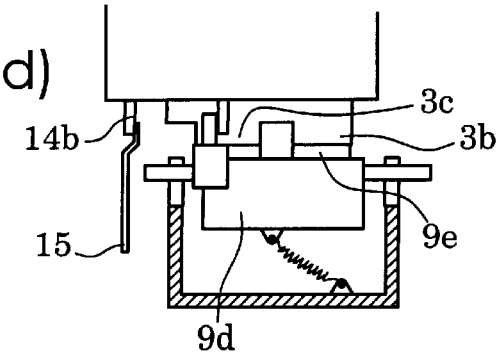

Then, as shown in FIG. 7*b*, the station main body 8 raises the cap carriage 10 to a height at which the engaging pin 14*c* and the stepped part 14*a* can engage each other. The engaging pin 14*c* and right side of stepped part 14*a* are then engaged by moving the recording head carriage 3 to the left side and the cap carriage 10 is moved slightly to the left side, as depicted in FIG. 7*c*. Assured capping is possible when the cap carriage 10 is raised and the cap members 9*e* and 9*d* are pressed against the nozzle members 3*b* and 3*c*. See FIG. 7*d*. At the maintenance station 4*a*, when the cap members 9*e* and 9*d* are pressed against the nozzle members 3*b* and 3*c*. The fixing pin 15 and the engaging pin 14*c* can be inserted between the two projections 14*a* and 14*b* and the recording head carriage 3 can be fixed by raising the fixing pin 15 and engaging the left side projection 14*b*.

Figure 9:
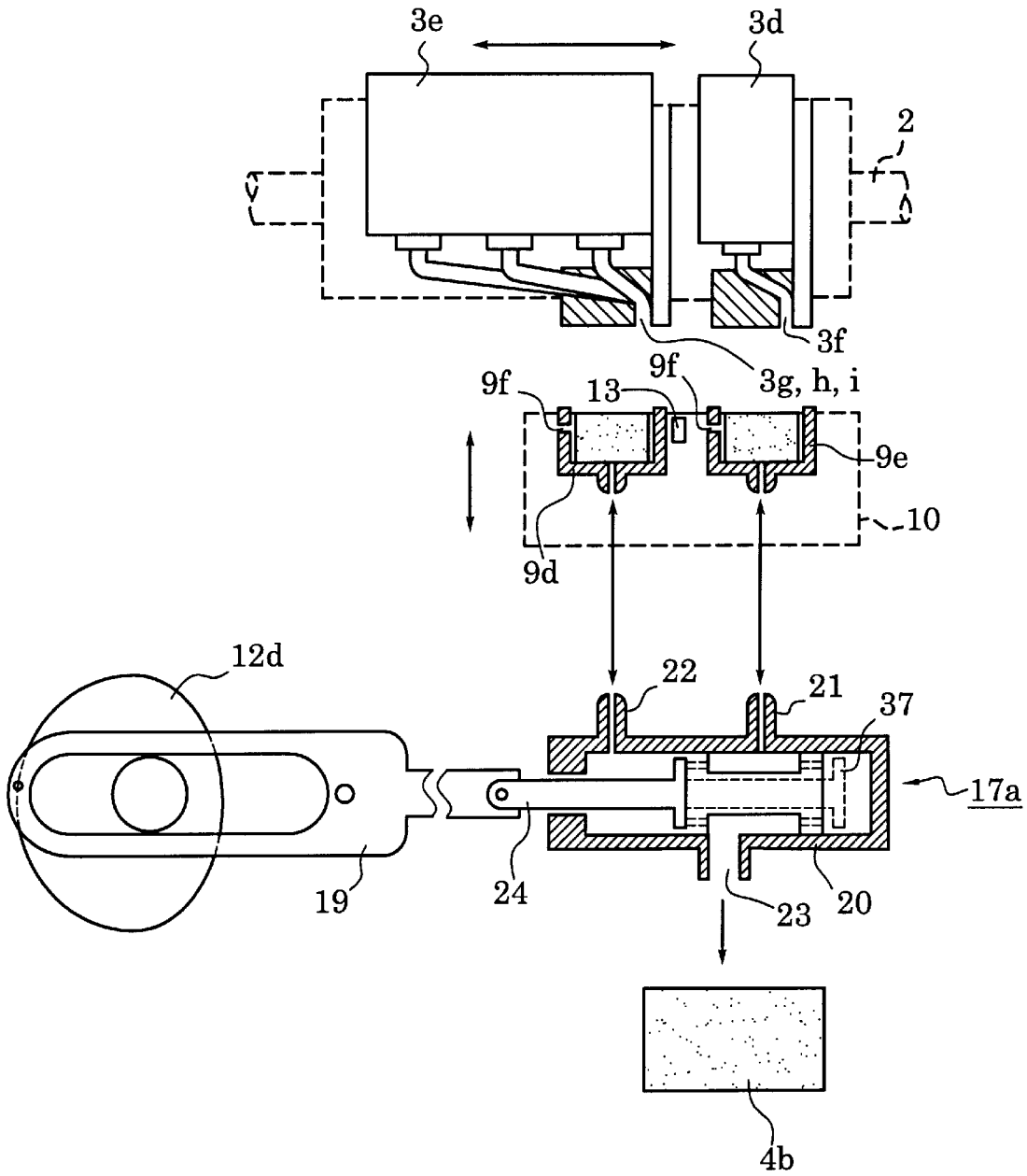
FIG. 9 is a partial cross-sectional side view of a pump member.

Further, in FIGS. 5 and 9, pump 17*a* and the pair of hoses 17*b* of pump member 17 connect to cap member 9*e* and 9*d*. The ink of each cap member 9*e* and 9*d* can be suctioned by the single pump 17*a*. Moreover, a waste ink conductor, or ink expulsion path forming member, 18 is connected to an exhaust port 23 of the pump 17*a* and is structured so that the ink is expelled to the expelled ink storing member 4*b* from the waste ink conductor 18. Accordingly, in the ink-jet type image forming apparatus 100 of this embodiment, the entire body of the apparatus 100 is miniaturized by setting the ink flowpath in a horizontal orientation from the pump 17*a* to the expelled ink storing member 4*b*.

Figure 10A:
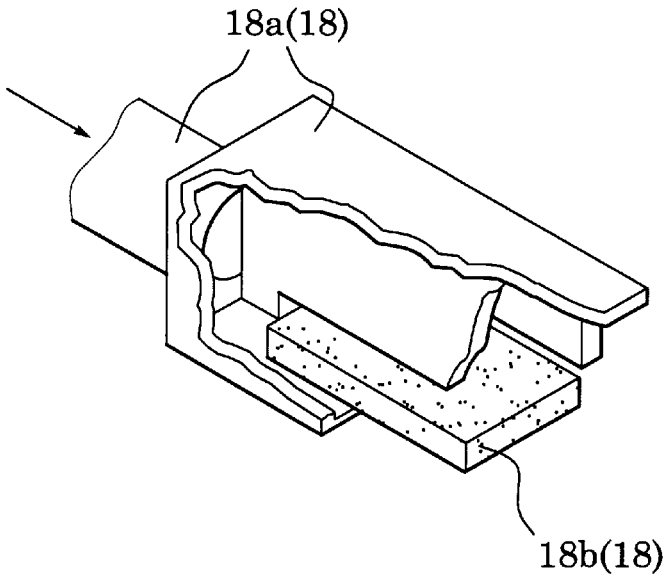
FIG. 10A is a partially broken away perspective view of a waste ink conductor.
Figure 10B:
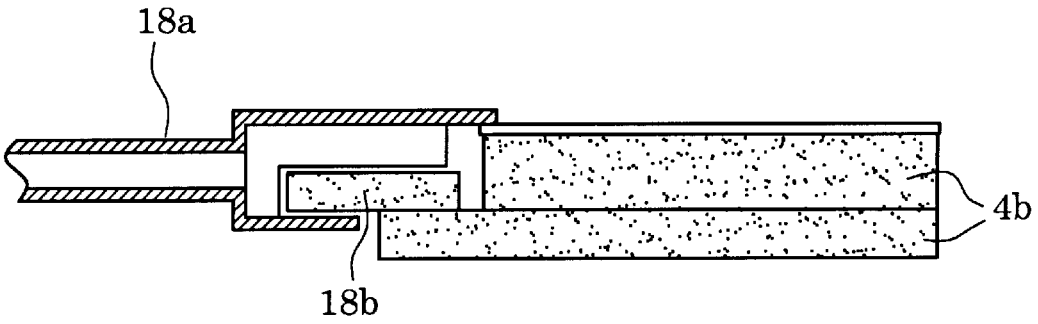
FIG. 10B is a cross-sectional side view of the waste ink conductor of FIG. 10A.

The waste ink conductor 18, as shown in FIG. 10, not only is formed in a shape so that two tubes of differing sizes are connected, but also comprises an ink guide tubular member 18*a*. A rib is formed in the wider of the tubular members and an ink transfer suction member 18*b* is arranged at the bottom part of this tubular member with itself comprising a porous member. Moreover, the ink guide tubular member 18*a* is connected so that ink flows from the narrower of the tubular members toward the wider of the tubular members. Below, the narrower tubular member is referred to as the upstream side tubular member and the wider of the tubular members is referred to as the downstream side tubular member. Furthermore, the connection portions are referred to as the flowpath diameter border parts.

The rib is formed so that it does not contact the ink transfer suction member 18*b* at the ink flowpath diameter border part, as well as being formed roughly in an L-shape so that the ink transfer suction member 18*b* does not block the flowpath. In this embodiment, the flowpath diameter border part and the ink transfer suction member 18*b* are separated by about 1 mm.

The ink transfer suction member 18*b* is formed of a material capable of maintaining (holding) ink in the same way as the expelled ink storing member 4*b*. Specifically, felt comprising polyester or a mixture of polyester and rayon is formed in which the density of the ink transfer storing member 18*b* is 1.2 kg/cm$^3$ and the density of the expelled ink storing member 4*b* is 1.8 kg/cm$^3$. Accordingly, the ink holding power of the expelled ink suction member 4*b* is larger than that of the ink transfer storing member 18*b*.

Figure 11:
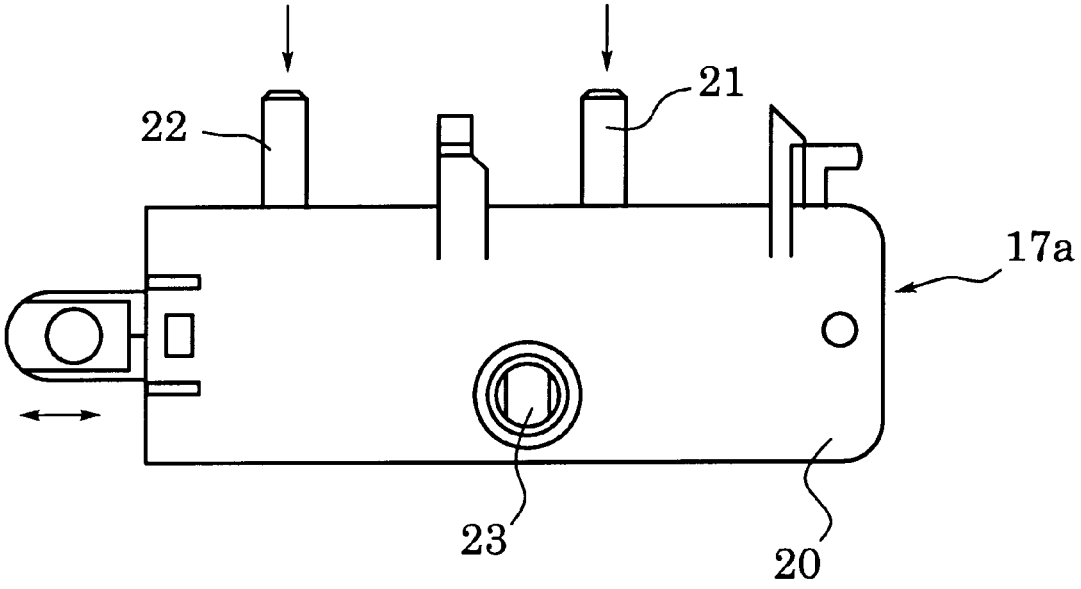
FIG. 11 is a front elevational view of the pump.
Figure 12:
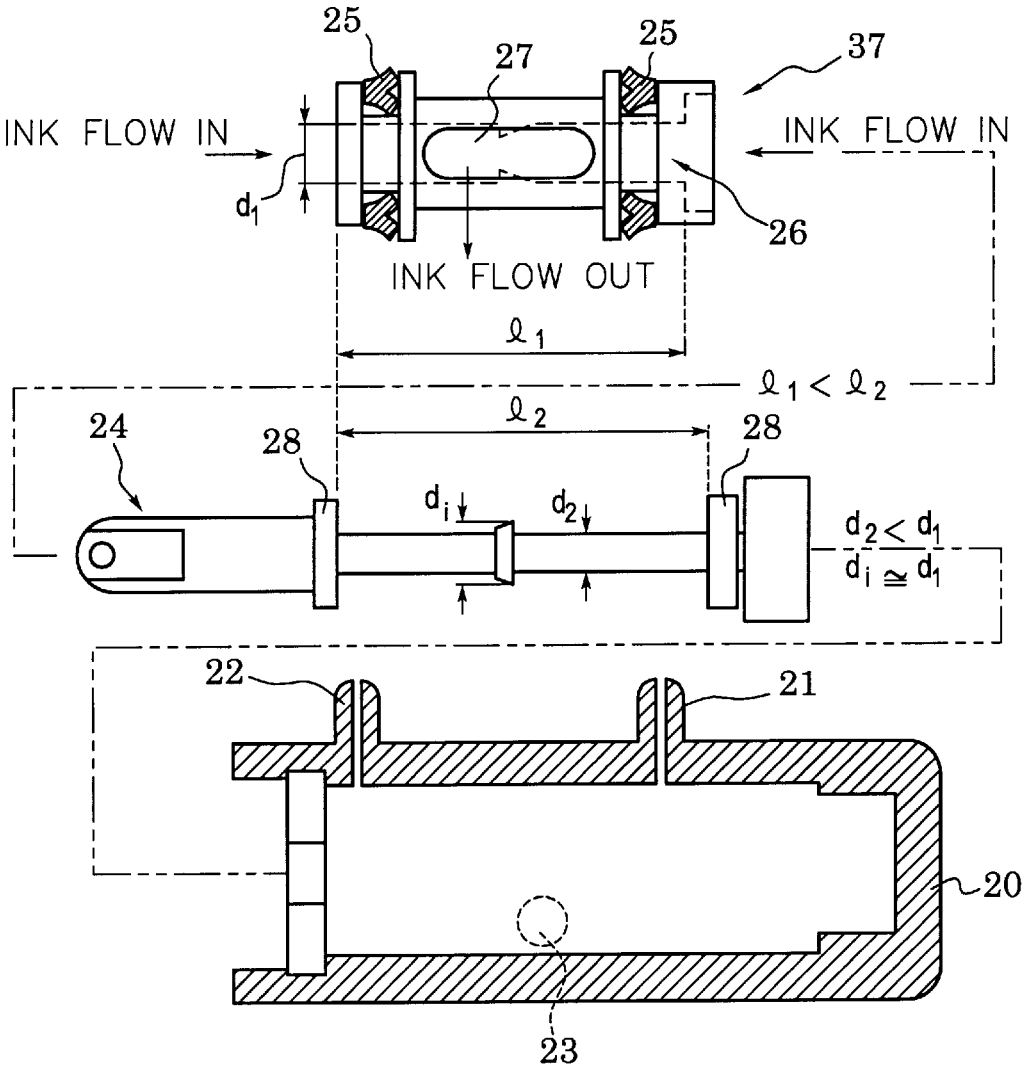
FIG. 12 is an exploded side view of the pump.
Figure 13A:
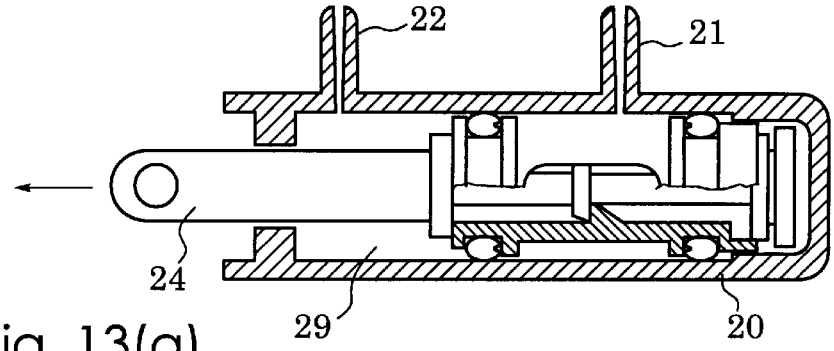
FIGS. 13A–13D are cross-sectional side views of the pump at various operational positions.
Figure 13B:
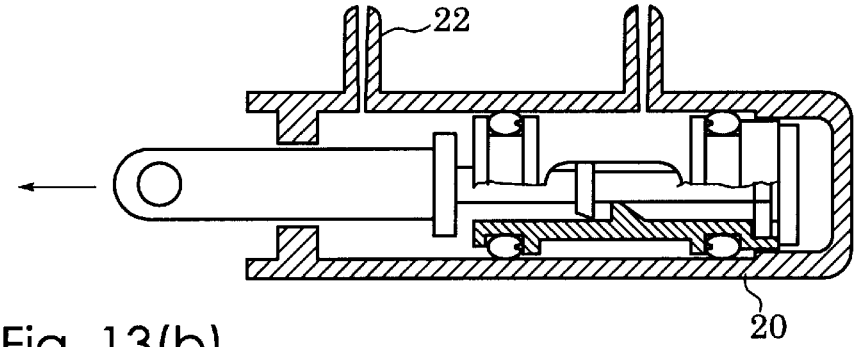
Figure 13C:
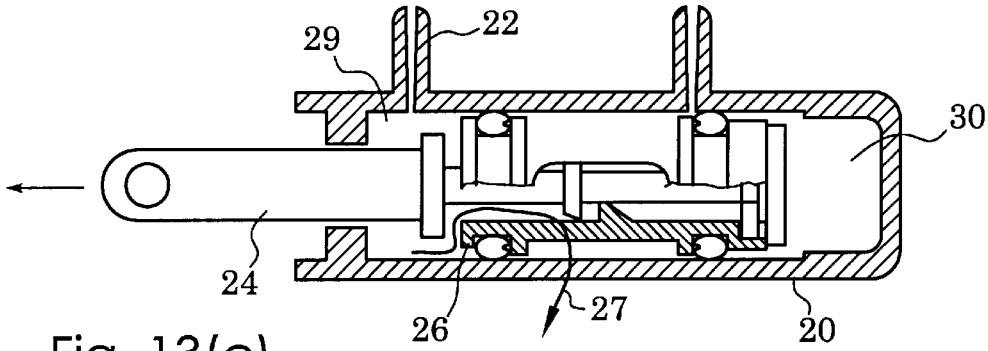
Figure 13D:
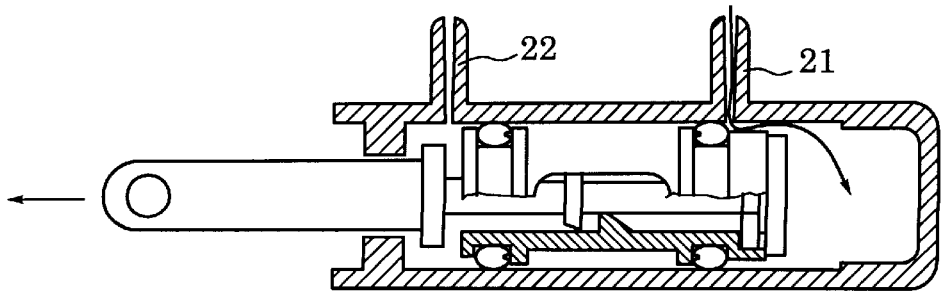

As shown in FIG. 11, the pump 17*a* has two ink absorbing ports 21 and 22 formed in the upper portion of a cylinder 20. An ink exhaust port 23 is formed in the bottom center part of the cylinder 20 in order to make the expulsion of ink easier. Hereafter, the ink absorbing port 21 that is connected to the right side cap member 9*e* is called the right side ink suction port, while the ink absorbing port 22 that is connected to the left side cap member 9*d* is called the left side ink suction port. Moreover, as indicated in FIG. 12, the cylinder 20 receives a piston that is the same size as the inner circumferential surface of the cylinder 20. The piston comprises a piston head 37 that has a through-hole 26 formed in the center portion thereof and a piston rod 24 that is formed with a diameter d2 that is smaller than the diameter d1 of the through-hole 26.

Specifically, the piston head 37 comprises a pair of rubber piston rings 25, one at each end of the piston head 37 and positioned around the circumference thereof. An ink drain port 27 is formed in the side of the piston head 37 and between the piston rings 25 while also being in communication with the through-hole 26.

The piston rod 24 has a pair of through-hole sealing plates 28 that are sized to seal the through-hole 26 of the piston head, and the through-hole sealing plates 28 are arranged and installed at a spacing $l_2$ that is a little longer than the length $l_1$ of the through-hole 26 of the piston head 37. Moreover, the piston rod 24 is connected to the cam 12*a* of the cam drive transferring member 12 through the drive transferring arm 19.

Figure 14A:
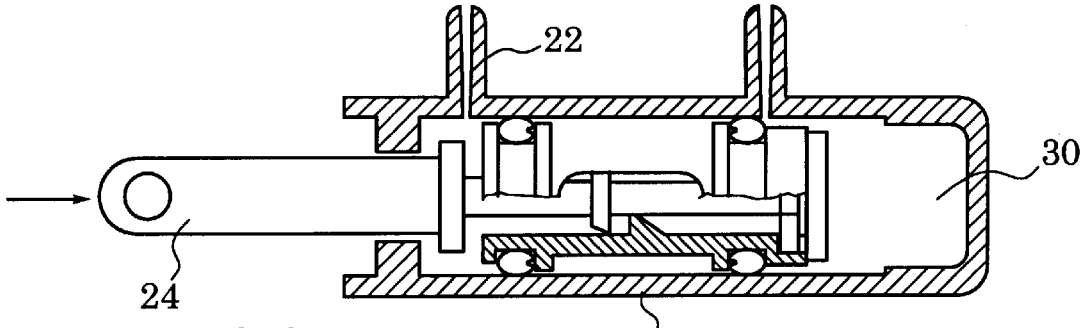
FIGS. 14A–14C are cross-sectional side views of the pump at various operational positions.
Figure 14B:
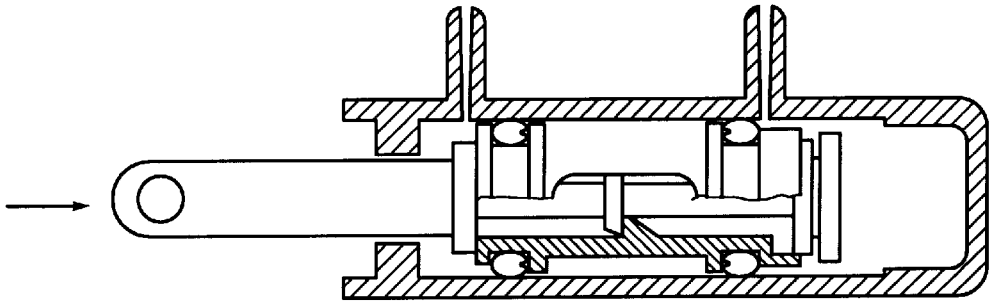
Figure 14C:
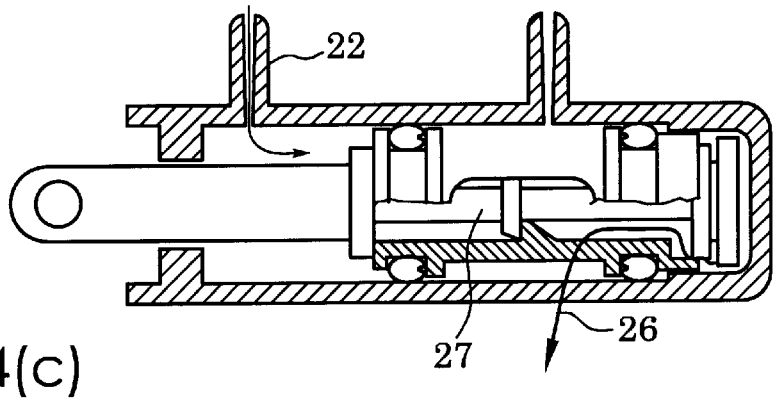

The pump 17*a*, as shown in FIG. 13, suctions ink in from the right side ink suction port 21 and expels ink held in the left side 29 of the piston 24 through the through-hole 26 and the ink exhaust port 23 via the ink drain port 27. Moreover, as indicated in FIG. 14, the pump 17*a* suctions ink away from the left side ink suction port 22 as the piston rod 24 is pushed back. Also, the waste ink, which was kept in the right side 30 of the piston, is expelled from the ink exhaust port 23 via the through-hole 26 and the ink drain port 27.

Figure 15:
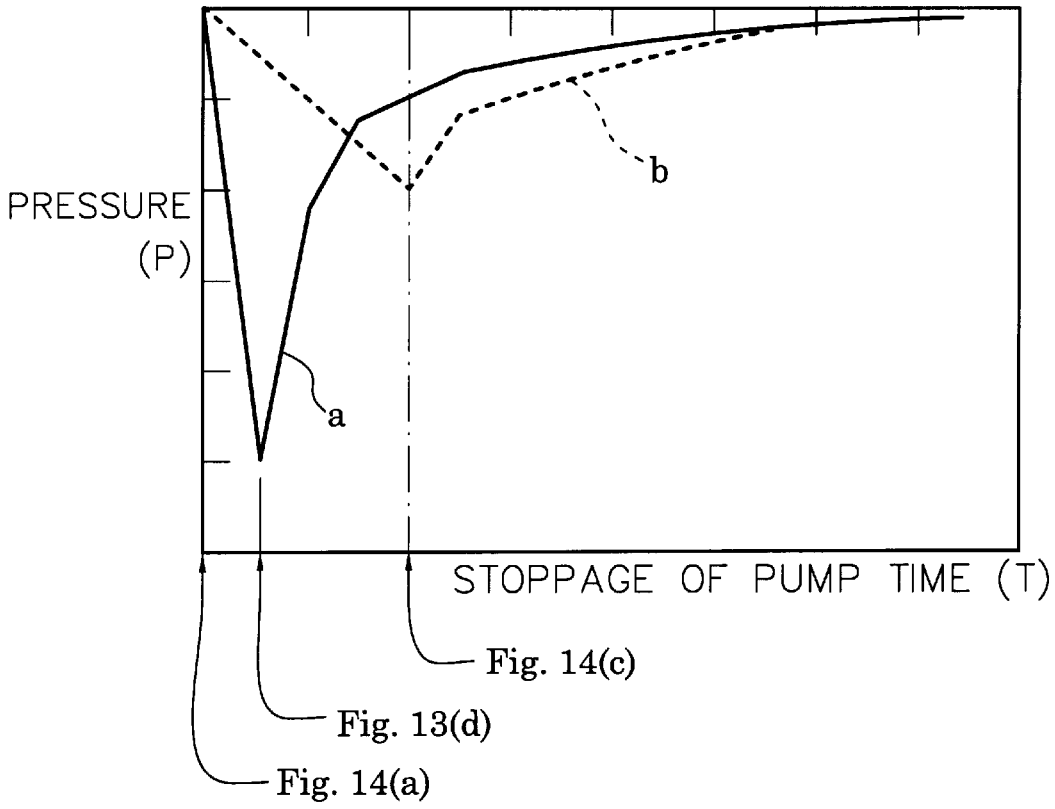
FIG. 15 is a chart reflecting a suction pressure of the pump as a function of time.

Moreover, in this embodiment, extremely high pressure can be applied instantly, as indicated by the line (a) of FIG. 15, since the right side ink suction port 21 is formed near the center of the cylinder 20 and is arranged so as to communicate with the right side chamber 30 in the cylinder 20 when the piston head 37 is moved to some extent. On the other hand, the left side ink suction port 22 is arranged near the edge of the cylinder 20 and is arranged so as to communicate constantly with the inside of the cylinder 20 so that the low pressure, shown by line (b) in FIG. 15, acts for a relatively long time. Because of this, the right side ink suction port 21 adequately suctions the increased amount of tacky ink and the like clogged up within the nozzle part, while the left side ink suction port 22 suctions the remaining ink from within the cap member 9.

Figure 16B:
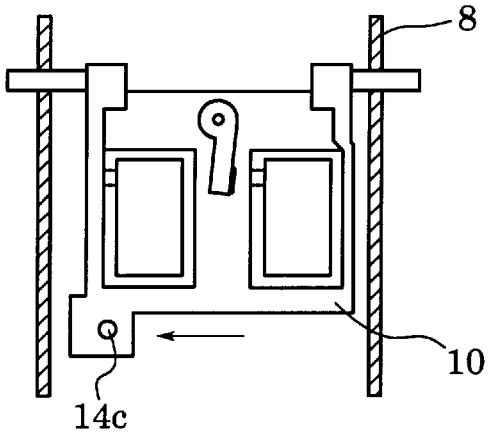
Figure 16C:
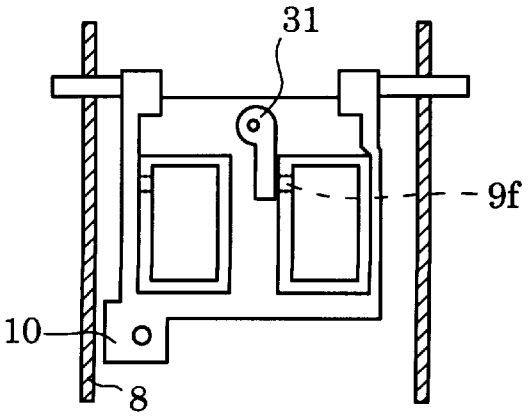

As illustrated in FIG. 5, cap through-hole sealing member 31 seals the through-hole 9*f* of the right side cap member 9*c* and is arranged on the cap carriage 10. Further, the cap through-hole sealing member 31, as indicated in FIG. 16, is configured such that the cap carriage 10 is pushed by the recording head carriage 3 and seals the through-hole 9*f* by moving to the left side.

Figure 17A:
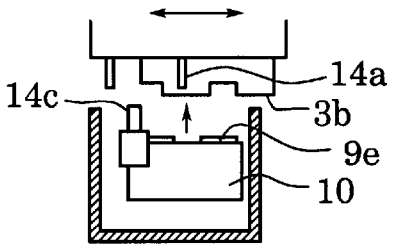
FIGS. 17A–17E are partial cross-sectional side views of a right side nozzle disposed in a sequence of right side nozzle positions.
Figure 17B:
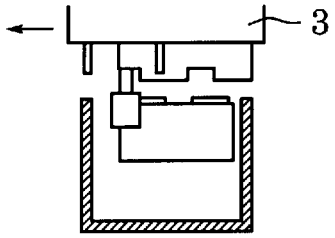
Figure 17C:
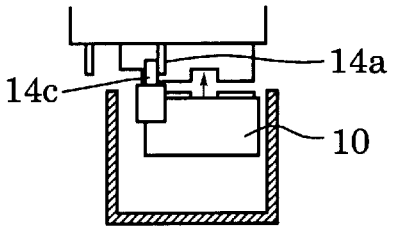
Figure 17D:
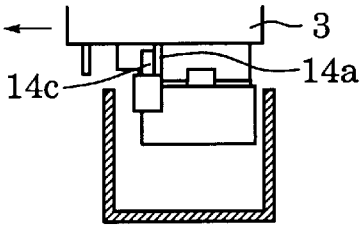
Figure 17E:
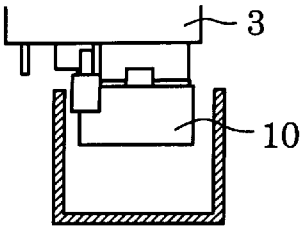

As shown in FIGS. 17A–17D, the station main body 4*a* causes the projection 14*a* on the right side to engage with the engaging pin 14*c*, thereby covering the black ink nozzle member 3*b* with the right side cap member 9*e* and moving the recording head carriage 3 to the left side. Consequently, the through-hole 9*f* of the cap member 9*e* on the right side is scaled with the seal valve 31, as shown in FIG. 17E. By operating the pump 17*a* in this state, it is possible to suction foreign material, such as ink having an increased viscosity, within the black ink nozzle 3*f*.

Figure 18A:
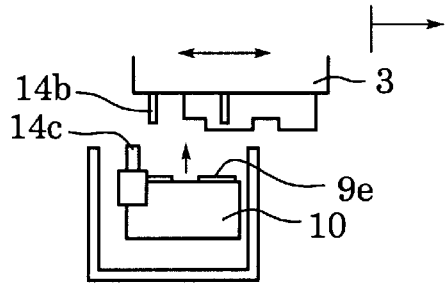
FIGS. 18A–18E are partial cross-sectional side views of a left side nozzle disposed in a sequence of left side nozzle positions.
Figure 18B:
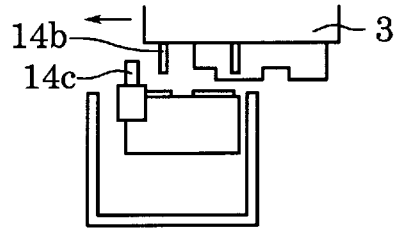
Figure 18C:
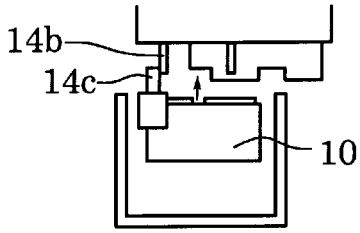
Figure 18D:
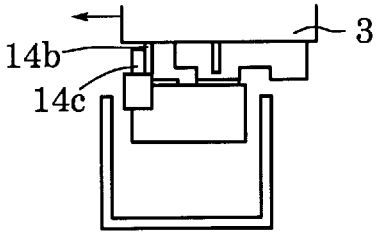
Figure 18E:
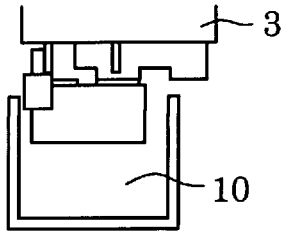

Moreover, as shown in FIGS. 18A–18C, the station main body 4*a* causes the projection 14*b* on the left side to engage with the engaging pin 14*c* and covers the color nozzle 3*c* by the cap member 9*e*, which is disposed on the right side. The recording head carriage 3 is moved to the left side and seals the through-hole 9*f* of the cap member 9*e* on the right side with the seal valve 31, as shown in FIG. 18E. By operating the pump 17*a* in this state, it is possible to suction foreign material, such as ink that has and increased viscosity, from within each of the nozzle members 3*b* and 3*c*.

Furthermore, returning to FIG. 17A, the station main body 4*a* positions the recording head carriage 3 so that each of the nozzle members 3*b* and 3*c* face the respective cap members 9*e* and 9*d*. Ink is ejected from nozzle members 3*b* and 3*c* and received at each cap member 9*e* and 9*d*. The ink is suctioned away as the pump 17*a* is operated with the recording head carriage 3 in this state.

Moreover, as shown in FIG. 5, wiper 32 has a rubber blade. A force is applied by a spring 33 provided between the station main body 4*a* and the wiper 32. The height of the wiper 32 can be set by pushing down on the wiper 32 through the cam drive transferring member 12. Also, as illustrated in FIG. 19B, it can be seen that ink absorption bodies 3*j* and 3*k* are made from sponges.

Figure 19A:
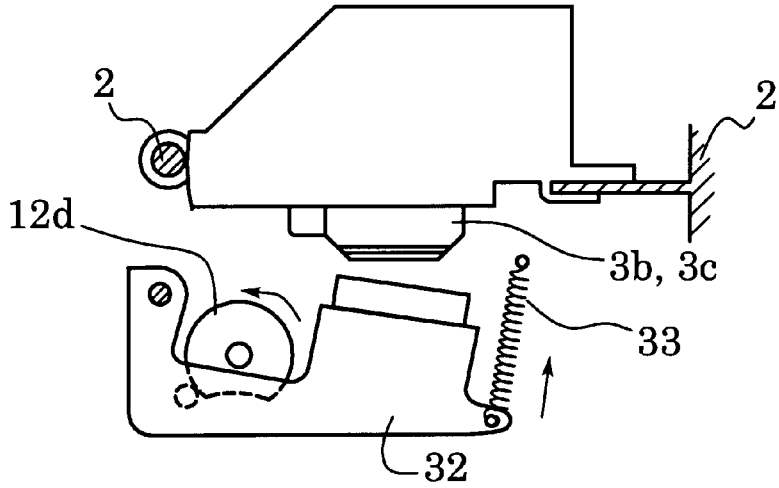
FIG. 19A is a side elevational view of a wiper member.
Figure 19B:
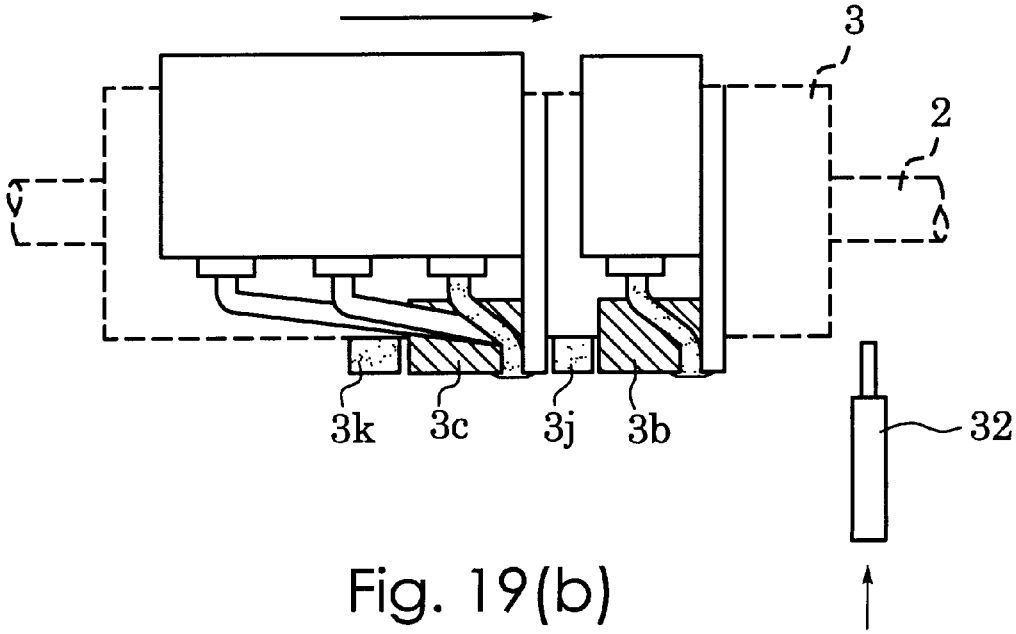
FIG. 19B is a top plan view of the wiper member in FIG. 19A.

Further, as shown in FIG. 19A, the station main body 4*a* is moved such that the rubber blade edge of the wiper 32 is positioned in the path of movement of the nozzle members 3*b* and 3*c*, and the recording head carriage 3 is moved from the home position to the right side. Thus, the blade can contact the edge of each nozzle member 3*b* and 3*c*. Moreover, after contacting the edge of each nozzle member 3*b* and 3*c*, the blade is cleaned by the ink absorbing bodies 3*j* and 3*k* so that the black ink does not mix with the other ink colors.

As depicted in FIG. 5, the drive means has gear train 35 transferring the rotation of the pulse motor 34 to the cam drive transferring member 12 while sensor 36 detects the rotating phase of the cam drive transferring member 12.

Figure 21:
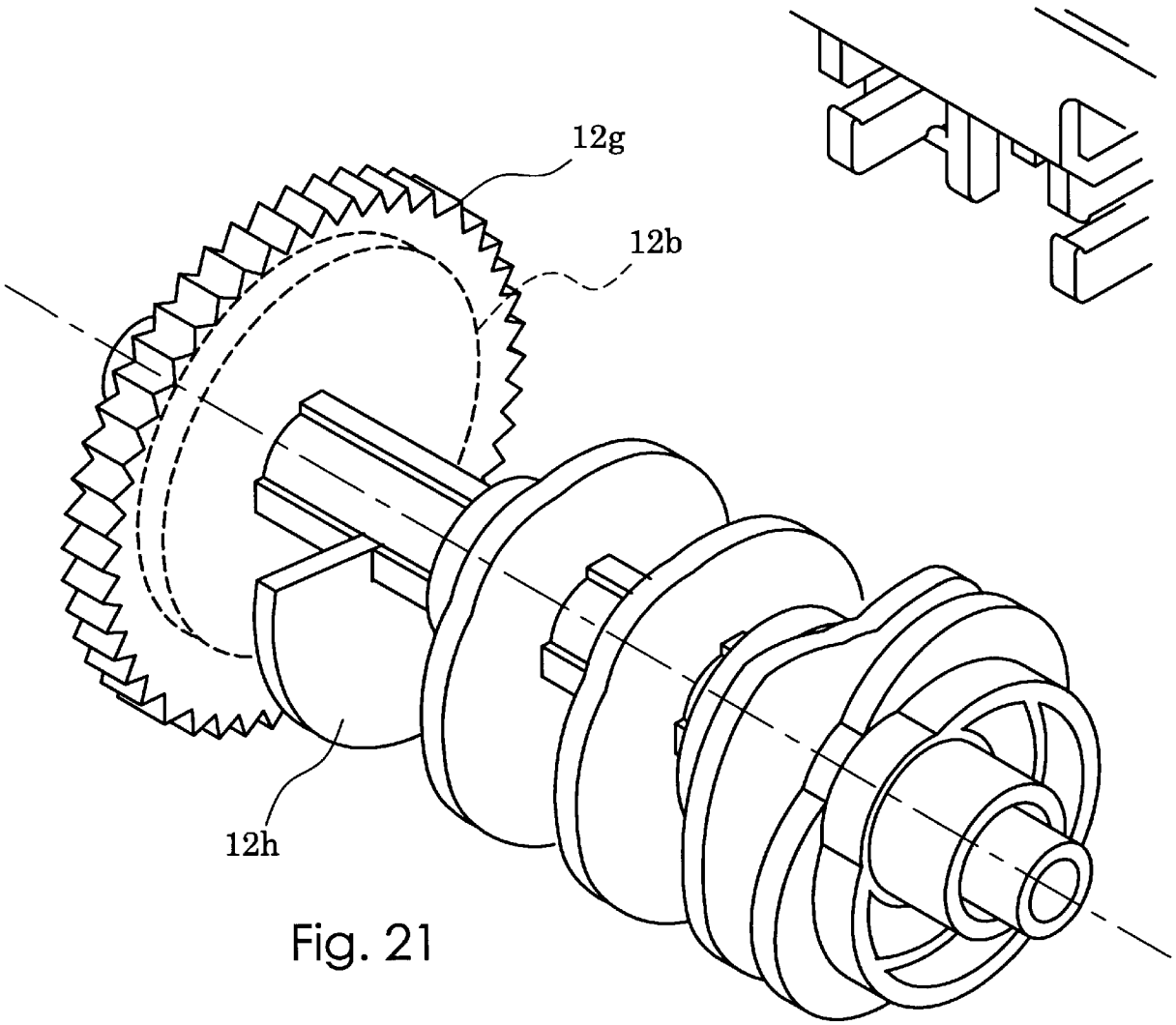
FIG. 21 is a perspective view of the cam drive transferring member.

Turning to FIG. 21, it can be seen that cam drive transferring member 12 has the capping cams 12*a* that move the cap members 9*c* and 9*d* vertically. A channel cam 12*b* in a gear 12*g* moves the fixed pin 15 vertically while pumping cam 12*d* drives the pump 17*a*. Wiping cam 12*c* moves the wiper member 32 vertically while cam member 12*h* engages the sensor 36.

Figure 20:
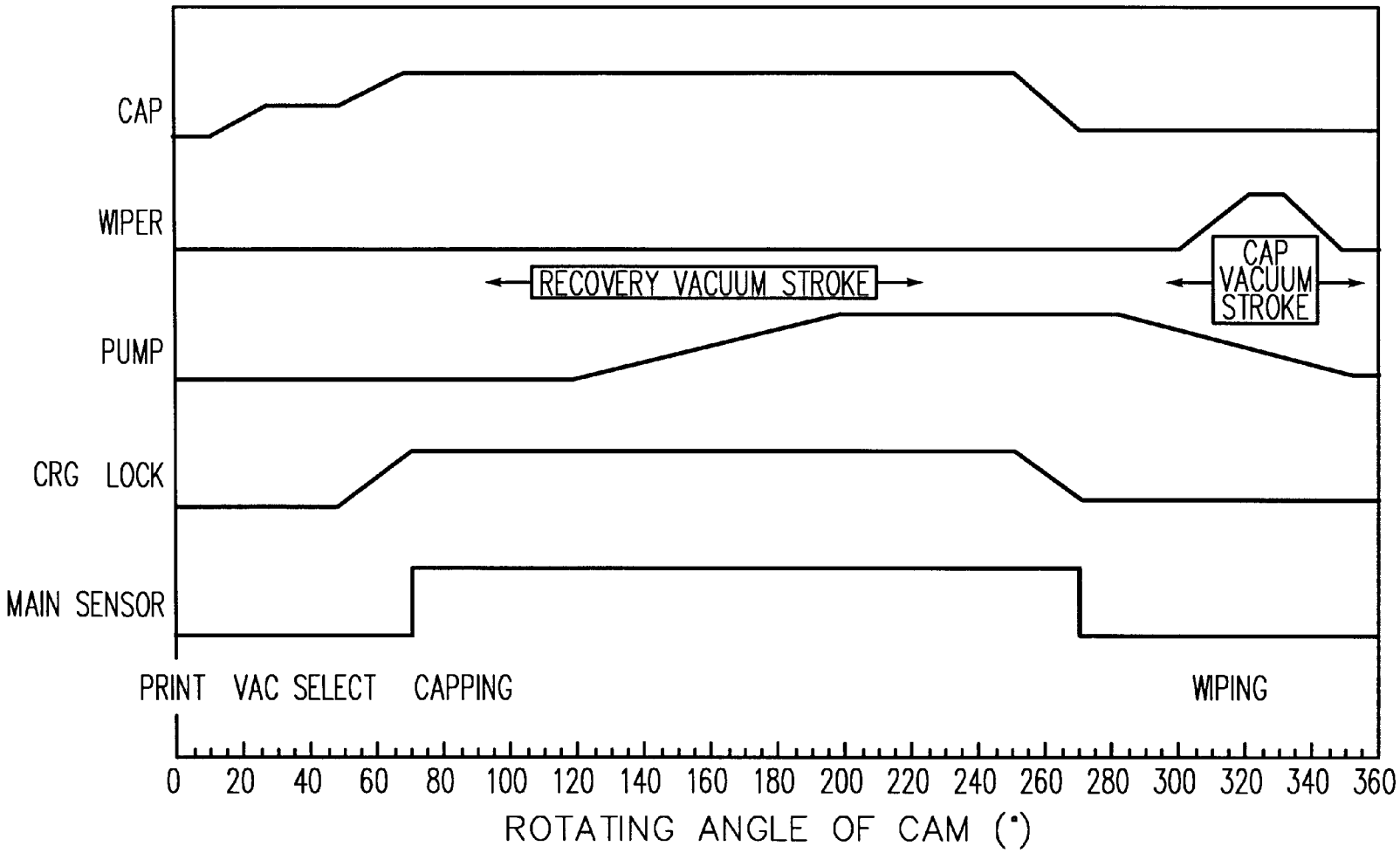
FIG. 20 is a chart illustrating respective conditions of the cap member, the wiper member, the pump, a CRG lock and a main sensor as a function of a cam angle.

Also, the cam angles of the gear groove and other cams, are formed so as to drive each member against the fixed rotating phase of the cam drive transferring member 12. Looking to FIG. 20, an image forming mode arises when cap members 9*e* and 9*d,* engagement pin 14*c,* fixing pin 15 and wiper 32 are in a retreated position in the rotating phase 350–10° of cam driving member 12. A cap position-determining mode occurs when the cap carriage 10 is raised to a half position when the rotating phase is 30–50°. A carriage stopping mode is in effect when cap members 9*e* and 9*d,* engagement pin 14*c* and fixing pin 15 is raised when the rotating phase is 70–120°. The vacuum mode arises when the pump 17*a* is driven in a condition in which cap members 9*e* and 9*d,* engagement pin 14*c* and the fixing pin 15 are raised in the rotating phase 120–200°. A cap interior space vacuum mode occurs when pump 17*a* is driven such that cap members 9*e* and 9*d,* engagement pin 14*c* and the fixing pin 15 are retreated when the rotating phase is 280–350°. Moreover, a wiping mode is in effect when the wiper 32 is raised when the rotating phase is 320–330°. The cap interior space vacuum mode is used for suctioning the ink discharged from the dummy jet.

Then, in this embodiment, when an image is not being formed, not only is the recording head carriage 3 set in the home position, but it is also set in a carriage stopping mode. Also, when the image formation begins, it is set so that it enters into the image forming mode after executing the dummy jet mode and wiping mode. After image formation has been completed, it is further set so that it goes to the carriage stopping mode after executing the cap position-determining mode. Moreover, experiments were conducted in which, based on a command by the user, it was set so as to execute the vacuum mode.

As a result, in the ink-jet type image forming apparatus 100, there is no clogging of nozzles 3*b* and 3*c* when they are used for a long period of time and therefore no failure of image forming. Also, even if clogging of the nozzles 3*b* and 3*c* were to occur after this period of time, it would be possible to recover immediately.

Moreover, in the ink-jet type image forming apparatus 100 of this invention, with the one pulse motor 34, it became possible to position-determine the cap members 9*e* and 9*d,* the wiper member 32, the carriage position fixing member 15 and the cap through-hole sealing member 31 so that they advance with respect to the path of motion of the recording head carriage 3. Also, since the pump 17*a* is operated, there is no need to install a drive means individually for each member, thus making it possible to greatly reduce the size of the apparatus 100.

Next, in an ink-jet type image forming apparatus 100 of this embodiment, although one portion of the ink flowpath is set in a horizontal direction from the cap members 9*e* and 9*d* to the expelled ink storing member 4*b,* there is no evidence, even when used for a long time, that expelled ink becomes clogged in the ink flowpath and cannot be expelled. Also, there is no need to replace the expelled ink storing member 4*b* when using the apparatus 100 for a long time. Furthermore, there is no scattering of ink onto surrounding parts, and it is possible by the expelled ink storing member 4*b* to suction ink efficiently, easily, and in large quantities.

Furthermore, in an ink-jet type image forming apparatus of this embodiment, ink does not drop down from the ink expulsion path forming member 18 even when the expelled ink storing member 4*b* is replaced directly after image forming.

As described above, in the ink-jet type image forming apparatus 100 of the present invention, because the ink expulsion path forming member 18 has an ink guide tubular member 18*a* that causes the ink to flow through the interior of the ink guide tubular member 18*a,* ink transfer suction member 18*b* is arranged in the ink guide tubular member 18*a* is capable of maintaining the ink. Thereby allowing the ink expulsion path forming member 18 to expell the ink smoothly to the expelled ink storing member 4*b*. For this reason, it is possible for the expelled ink to flow smoothly to the expelled ink storing member 4*b* even when the ink expulsion path is set in a horizontal direction.

Accordingly, it is also possible in an ink-jet type image forming apparatus 100 of the present invention to miniaturize the apparatus.

While the invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. An ink-jet type image forming apparatus, comprising:

at least one nozzle part for ejecting ink corresponding to prescribed image information;

at least one cap member arranged oppositely to said at least one nozzle part;

an expelled ink storing member; and an ink expulsion path forming member fluidwise communicating said at least one cap member with said expelled ink storing member, said ink expulsion path forming member including an ink transfer suction member arranged in a tubular ink guide member including an ink flowpath, said ink expulsion path forming member communicating with said at least one cap such that said ink transfer suction member is positioned between said at least one cap member and said expelled ink storing member, said ink transfer suction member being capable of holding ink, wherein said expelled ink storing member contacts said ink transfer suction member and is capable of holding ink, said expelled ink storing member having a larger ink holding power than said ink transfer suction member, and said expelled ink storing member is separate from said ink transfer suction member such that substantially no ink remains in said ink expulsion path forming member when said expelled ink storing member is replaced.

2. The ink-jet type image forming apparatus of claim 1, wherein said expelled ink storing member has a higher density than said ink transfer suction member.

3. The ink-jet type image forming apparatus of claim 1, further comprising a pump which moves expelled ink from said at least one cap member to said expelled ink storing member, wherein said ink flowpath of said tubular ink guide member includes a broadened portion between ends of said tubular ink guide member and said ink transfer suction member is arranged in said broadened portion of said ink flowpath.

4. The ink-jet type image forming apparatus of claim 3, wherein said ink transfer suction member is separated from a flowpath diameter border part in which dimensions of said flowpath of said tubular ink guide member change.

5. The ink-jet type image forming apparatus of claim 3, wherein said ink transfer suction member is arranged so that said ink flowpath of said tubular ink guide member is not entirely blocked by said ink transfer suction member.

6. An ink-jet maintenance station, comprising:

an expelled ink storing member; and an ink expulsion path forming member in fluidwise communication with said expelled ink storing member and being connectable to at least one cap member that receives ink from an ink nozzle, said ink expulsion path forming member including an ink transfer suction member arranged in a tubular ink guide member including an ink flowpath, said ink expulsion path forming member communicating with said at least one cap member such that said ink transfer suction member is positioned between said at least one cap member and said expelled ink storing member, said ink transfer suction member being capable of holding ink, wherein said expelled ink storing member contacts said ink transfer suction member and is capable of holding ink, said expelled ink storing member having a larger ink holding power than said ink transfer suction member; and said expelled ink storing member is separate from said ink transfer suction member such that substantially no ink remains in said ink expulsion path forming member when said expelled ink storing member is replaced.

7. The ink-jet maintenance station of claim 6, wherein said expelled ink storing member has a higher density than said ink transfer suction member.

8. The ink-jet maintenance station of claim 6, wherein said expelled ink storing member includes a porous material.

9. The ink-jet maintenance station of claim 6, further comprising a pump attached to said ink expulsion path to connect said ink expulsion path to said at least one cap member and to expel ink from said at least one cap member to said expelled ink storing member, wherein said ink flowpath of said tubular ink guide member includes a broadened portion between ends of said tubular ink guide member and said ink transfer suction member is arranged in said broadened portion of said ink flowpath.

10. The ink-jet maintenance station of claim 9, wherein said ink transfer suction member is separated from a flowpath diameter border part in which dimensions of said flowpath of said tubular ink guide member change.

11. The ink-jet maintenance station of claim 9, wherein said ink transfer suction member is arranged so that said ink flowpath of said tubular ink guide member is not entirely blocked by said ink transfer suction member.

12. The ink-jet maintenance station of claim 9, wherein said pump is attached to said at least one cap member.

13. The ink-jet maintenance station of claim 6, wherein said ink transfer suction member includes a porous material.

14. An ink-jet type image forming apparatus, comprising:

at least one nozzle part for ejecting ink corresponding to prescribed image information;

at least one cap member arranged oppositely to said at least one nozzle part;

an expelled ink storing member; and an ink expulsion path forming member fluidwise communicating said at least one cap member with said expelled ink storing member, said ink expulsion path forming member including an ink transfer suction member arranged in a tubular ink guide member, said ink expulsion path forming member communicating with said at least one cap member such that said ink transfer suction member is positioned between said at least one cap member and said expelled ink storing member, said ink transfer suction member being capable of holding ink, wherein said expelled ink storing member is in contact with the ink transfer suction member and is selected from the group consisting of a felt material and a perforated material and said expelled ink storing member is separate from said ink transfer suction member such that substantially no ink remains in said ink expulsion path forming member when said expelled ink storing member is replaced.

* * * * *